US008875349B2

(12) United States Patent
Hanigan

(10) Patent No.: US 8,875,349 B2
(45) Date of Patent: Nov. 4, 2014

(54) HINGE

(75) Inventor: Nicholas James Hanigan, Darwin (AU)

(73) Assignee: Rolling Hinge Pty Limited (AU)

( * ) Notice: Subject to any disclaimer, the term of this patent is extended or adjusted under 35 U.S.C. 154(b) by 0 days.

(21) Appl. No.: 13/153,978

(22) Filed: Jun. 6, 2011

(65) Prior Publication Data

US 2012/0110785 A1 May 10, 2012

Related U.S. Application Data

(63) Continuation of application No. 11/922,975, filed as application No. PCT/AU2006/000929 on Jun. 30, 2006, now Pat. No. 7,963,002.

(30) Foreign Application Priority Data

Jun. 30, 2005 (AU) ..... 2005903454

(51) Int. Cl.

| | |
|---|---|
| ***E05D 5/00*** | (2006.01) |
| ***E05D 3/10*** | (2006.01) |
| ***E05D 5/14*** | (2006.01) |
| ***E05D 5/02*** | (2006.01) |

(52) U.S. Cl.

CPC .. *E05D 3/10* (2013.01); *E05D 5/14* (2013.01); *E05D 5/02* (2013.01)

USPC ..... 16/382; 16/366

(58) Field of Classification Search

USPC ..... 16/382, 387, 366, 367, 355, 356, 239, 16/282, 287, 294, 302

See application file for complete search history.

(56) References Cited

U.S. PATENT DOCUMENTS

| | | | | |
|---|---|---|---|---|
| 1,100,684 | A | 6/1914 | Stoakes | |
| 1,441,350 | A | 3/1919 | Herrman | |
| 1,903,379 | A | 4/1933 | Bicknell | |
| 4,343,065 | A | 8/1982 | Liber | |
| 5,337,452 | A | 8/1994 | LeBlanc et al. | |
| 5,362,063 | A | 11/1994 | Cummings | |
| 7,007,346 | B2 | 3/2006 | Hoffman | |
| 7,974,091 | B2 * | 7/2011 | Griffin | 361/679.56 |
| 2004/0168591 | A1 | 9/2004 | Lynton | |

FOREIGN PATENT DOCUMENTS

| | | | |
|---|---|---|---|
| CN | 201470055 U | * | 5/2010 |
| GB | 313495 | | 4/1930 |
| WO | WO 2007/002998 | | 1/2007 |

* cited by examiner

*Primary Examiner* — William Miller
(74) *Attorney, Agent, or Firm* — Baker & Hostetler LLP

(57) ABSTRACT

A hinge comprising two pivoting elements adapted to hingedly join two articles, each pivoting element including attachment means for attaching to an article; wherein when attached to the two articles the hinge is rotatable with respect to the articles.

6 Claims, 12 Drawing Sheets

HINGE

CROSS-REFERENCE TO RELATED APPLICATIONS

This application is a continuation in part of U.S. Pat. No. 7,963,002, issued on Jun. 21, 2011, which claims priority to the PCT Application No.: PCT/AU2006/000929, filed Jun. 30, 2006, which claims priority to Australia Application No.: 2005903454, filed Jun. 30, 2005, the disclosures of which are hereby incorporated by reference as if set forth in their entirety herein.

TECHNICAL FIELD

The disclosure relates to a hinge.

SUMMARY

Disclosed is a hinge comprising two pivoting elements adapted to hingedly join two articles, each pivoting element including attachment means for attaching to an article; wherein when attached to the two articles the hinge is rotatable with respect to the articles.

In one form the hinge is rotatable with respect to the articles such that the direction of freedom of movement of the hinge is changed In one form the hinge further comprises a hinge pin.

In one form the attachment means comprises a hinge collar adapted to be attached to one of the two articles, wherein the hinge is rotatable with respect to the hinge collar.

In one form the axis of rotation of the pivoting elements and the axis of rotation of the hinge are perpendicular to one another.

In one form the hinge is rotatable between a locked position and an unlocked position

BRIEF DESCRIPTION OF THE DRAWINGS

To facilitate an understanding of the disclosure, reference is made in the description to the accompanying drawings illustrating a preferred embodiment of the hinge used in a folding chess board. It is to be understood that the hinge is not limited to the preferred embodiment as illustrated in the drawings.

In the drawings:

FIG. 28 is a perspective view of a second embodiment of a hinge;

DETAILED DESCRIPTION OF ILLUSTRATIVE EMBODIMENTS

Figure 1:
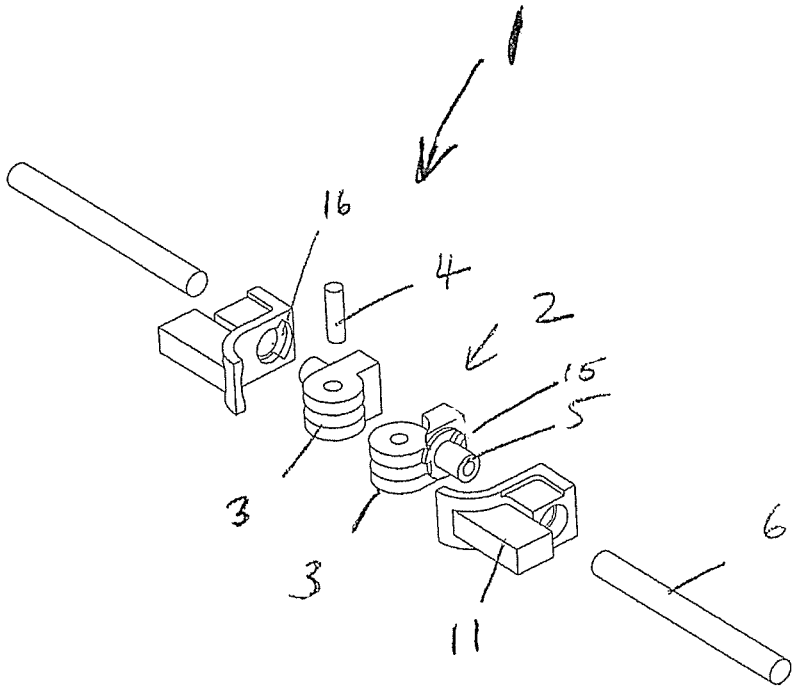
FIG. 1 is an exploded perspective view of the hinge of one embodiment of the present invention.
Figure 2:
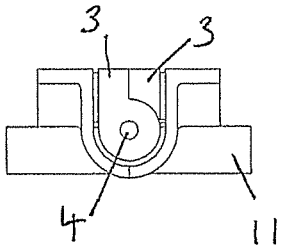
FIG. 2 is a front view of the hinge of FIG. 1 without attachment means.
Figure 3:
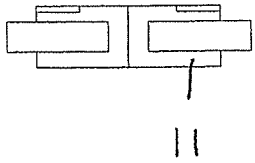
FIG. 3 is a top view of the hinge of FIG. 2.
Figure 4:
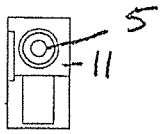
FIG. 4 is a side elevation view of the hinge of FIG. 2.
Figure 5:
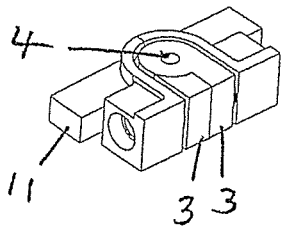
FIG. 5 is a perspective view of the hinge of FIG. 2.
Figure 6:
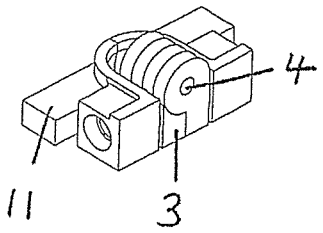
FIG. 6 is a perspective view of the hinge of FIG. 2 with the hinge element in a second position.
Figure 7:
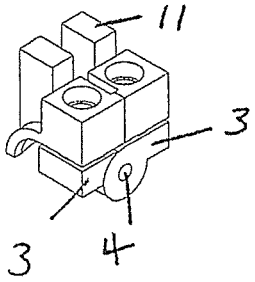
FIG. 7 is a perspective view of the hinge of FIG. 2 with the collar in a second position.
Figure 8:
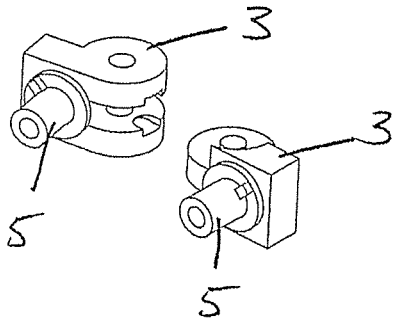
FIG. 8 is an exploded perspective view of the hinge of FIG. 1.
Figure 9:
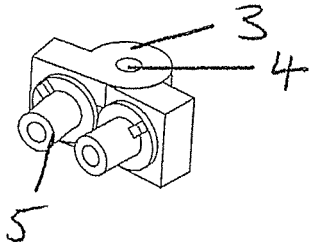
FIG. 9 is a perspective view of the hinge of FIG. 8 in a first position.
Figure 10:
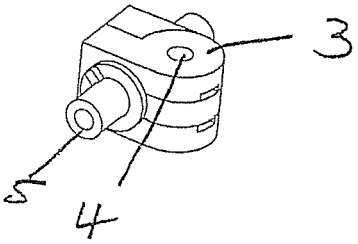
FIG. 10 is a perspective view of the hinge of FIG. 8 in a second position.
Figure 11:
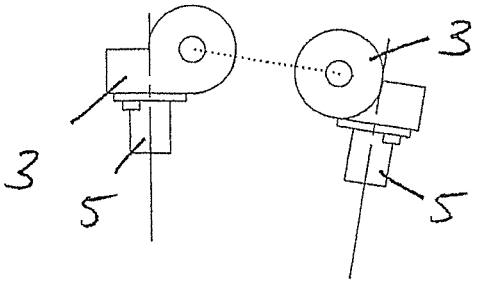
FIG. 11 is a side exploded view of the hinge of FIG. 8.
Figure 12:
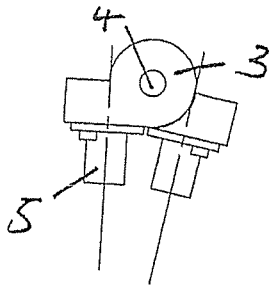
FIG. 12 is a side view of the hinge of FIG. 8 in a first position.
Figure 13:
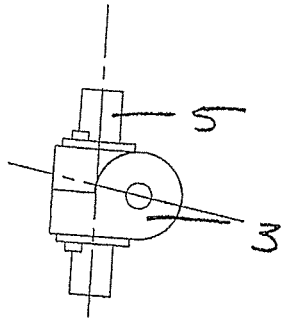
FIG. 13 is a side view of the hinge of FIG. 8 in a second position.
Figure 14:
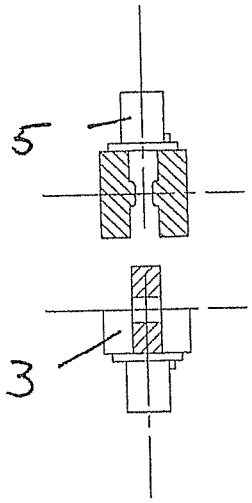
FIG. 14 is a cross-sectional exploded side view of a hinge element of a second embodiment of the invention.
Figure 15:
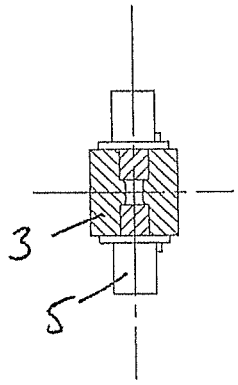
FIG. 15 is a cross-sectional side view of the hinge of FIG. 14.
Figure 16:
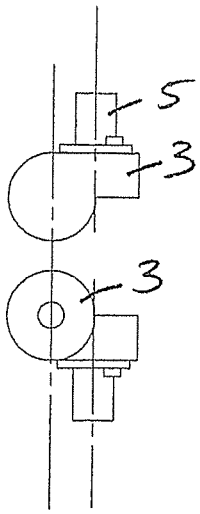
FIG. 16 is an exploded front view of the hinge of FIG. 14.
Figure 17:
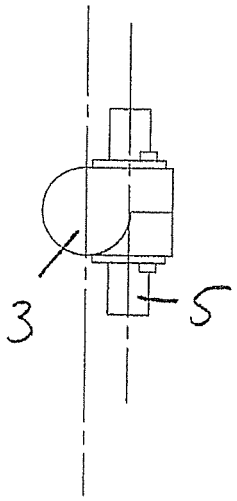
FIG. 17 is a front view of the hinge of FIG. 14.
Figure 18:
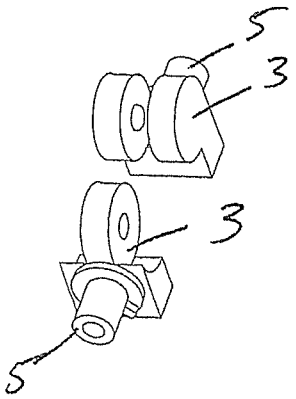
FIG. 18 is an exploded perspective view of the hinge of FIG. 14.
Figure 19:
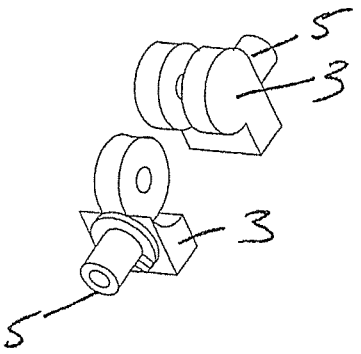
FIG. 19 is an exploded perspective view of the hinge of FIG. 14.
Figure 20:
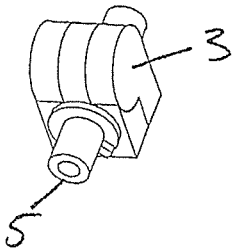
FIG. 20 is a perspective view of the hinge of FIG. 14.
Figure 21:
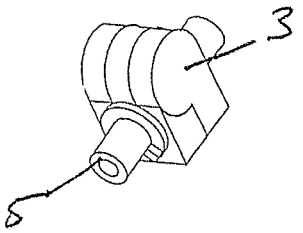
FIG. 21 is a perspective view of the hinge of FIG. 14.

Referring to the figures, there is shown a hinge 1 for allowing a relative motion between two solid articles. In the embodiment shown in the figures the solid articles are in the form of two chess board halves 30.

The hinge 1 comprises two pivoting elements 3. Each of the two independent pivoting elements 3 is attached to a hinge pin 4 such that at least one of the two independent pivoting elements is rotatable about the hinge pin 4. The two independent pivoting elements 3 are therefore rotatable in respect of one another.

Each of the two pivoting elements 3 further comprise a rotatable attachment means including connector 5, shaft 6 and collar 11.

The two pivoting elements 3 are moveable with respect to one another. As a result articles 30 attached with the pivoting elements 3 are moveable with respect to one another.

Figure 22:
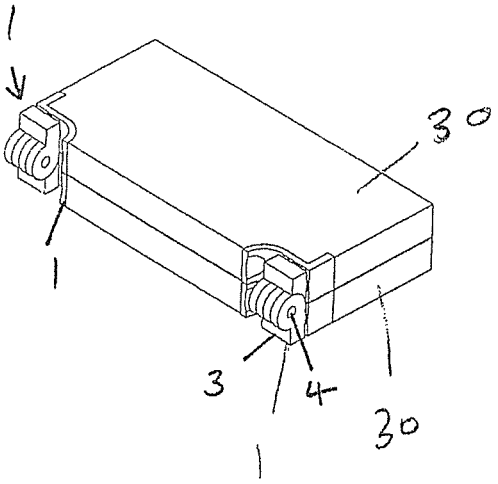
FIG. 22 is a perspective view of the hinge of one embodiment of the present invention in use.
Figure 23:
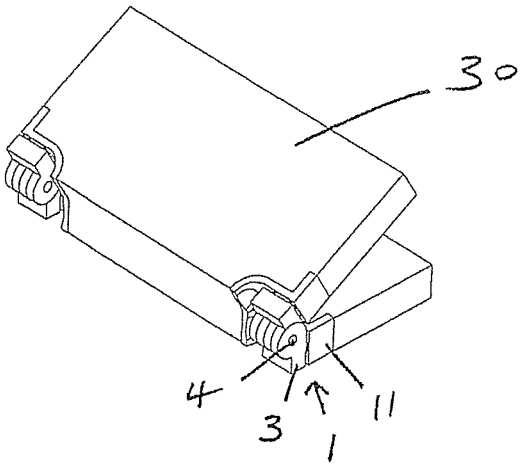
FIG. 23 is a perspective view of the hinge of FIG. 22 in use in a second position.
Figure 24:
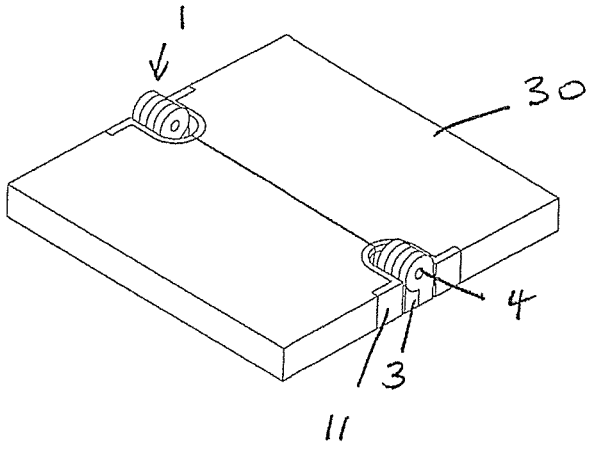
FIG. 24 is a perspective view of the hinge of FIG. 22 in use in a third position.
Figure 25:
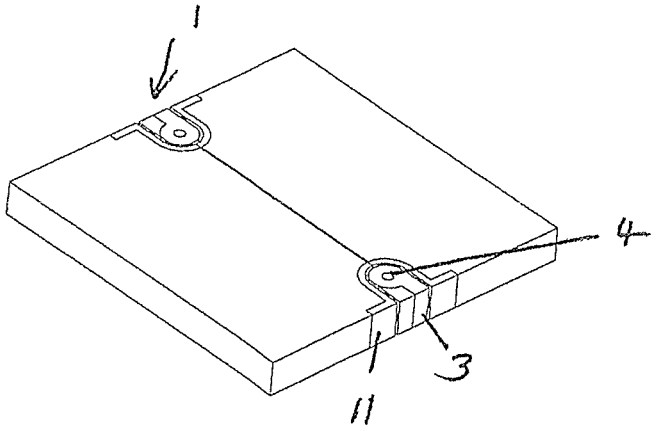
FIG. 25 is a perspective view of the hinge of FIG. 22 in use in a fourth position.

The connectors 5 are adapted to be fitted into the two solid articles 30, such that the two solid articles 30 extend outwardly from the connectors 5. As seen in FIGS. 22 through 25, in this form movement of the pivoting elements 3 brings the two solid articles 30 from a parallel and adjacent position as shown in FIG. 22 to a colinear position as shown in FIG. 25.

The shaft 6 adds strength and length to the hinge 1 to bear the load of the solid articles 30 beyond the pivoting elements 3.

Each hinge collar 11 is adapted to be rotatably attached with connector 5. Shaft 6 is provided with a screw thread or other means to engage with connector 5. Hinge collar 11 is positioned about shaft 6 or connector 5. The hinge 1 and connectors 5 can thus rotate with respect to the collars 11. The collars 11 are shaped to curve over the hinge element but can be any shape.

Figure 26:
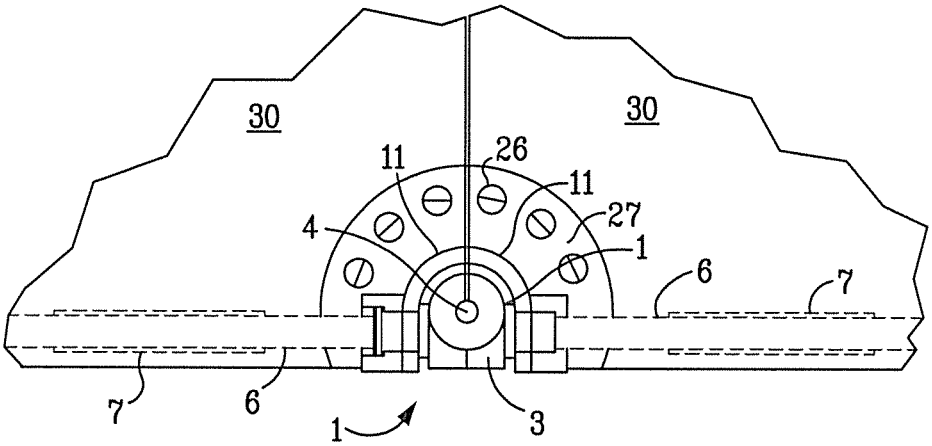
FIG. 26 is a cross-sectional top view of an embodiment of the hinge in locked position in use.
Figure 27:
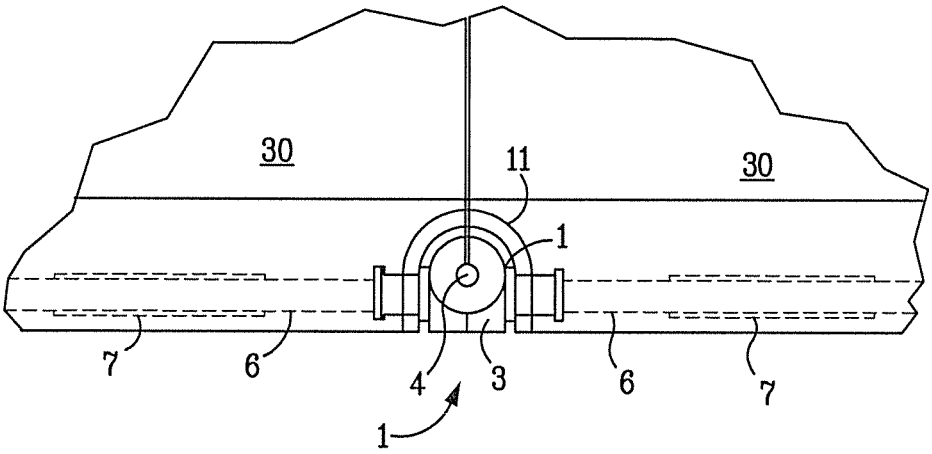
FIG. 27 is a cross sectional bottom view of the hinge of FIG. 26.
Figure 2B:
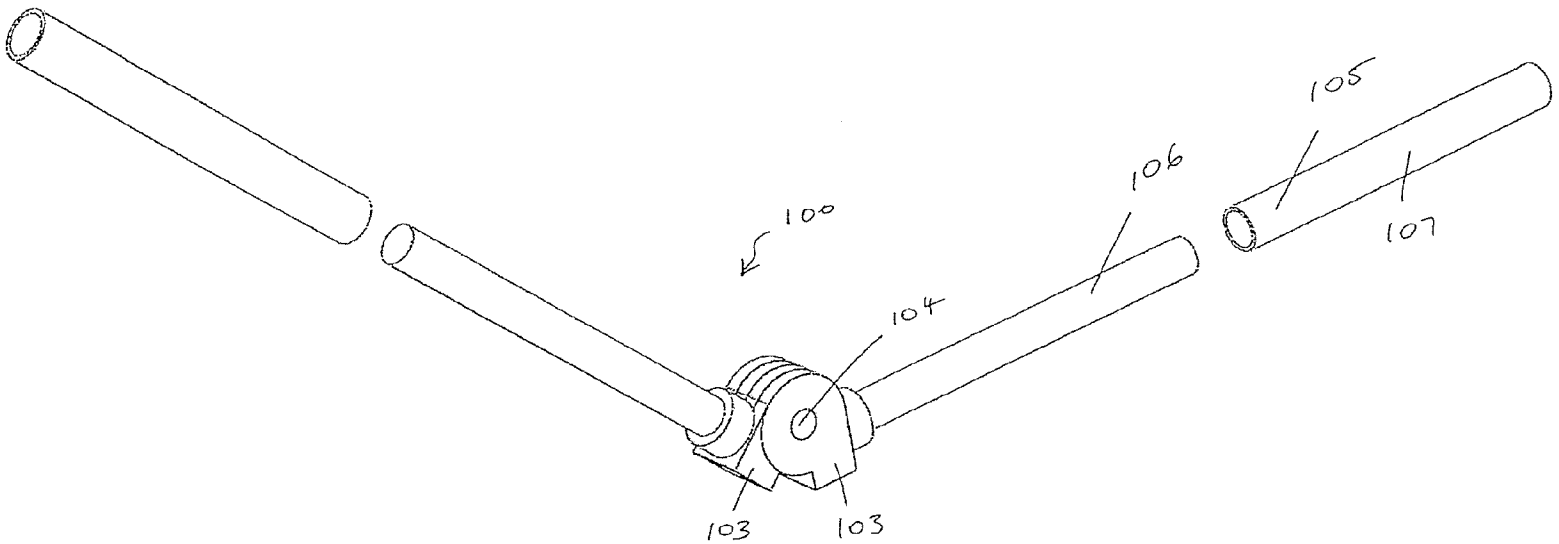
Figure 29:
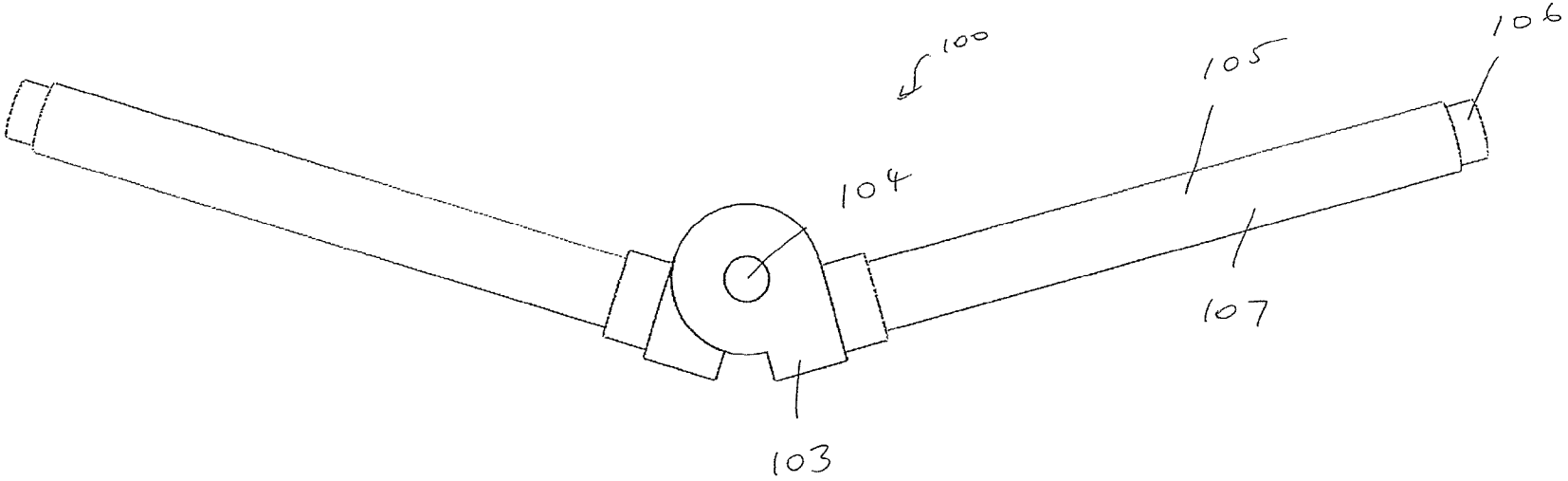
FIG. 29 is a front view of the hinge of FIG. 28.
Figure 30:
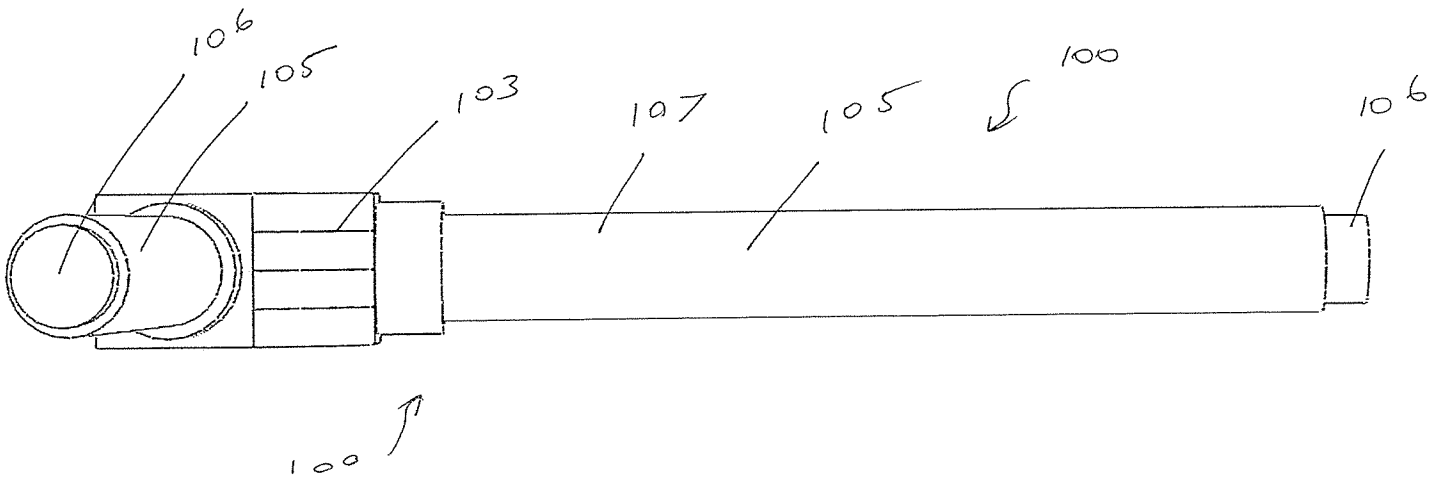
FIG. 30 is an end view of the hinge of FIG. 28.
Figure 31:
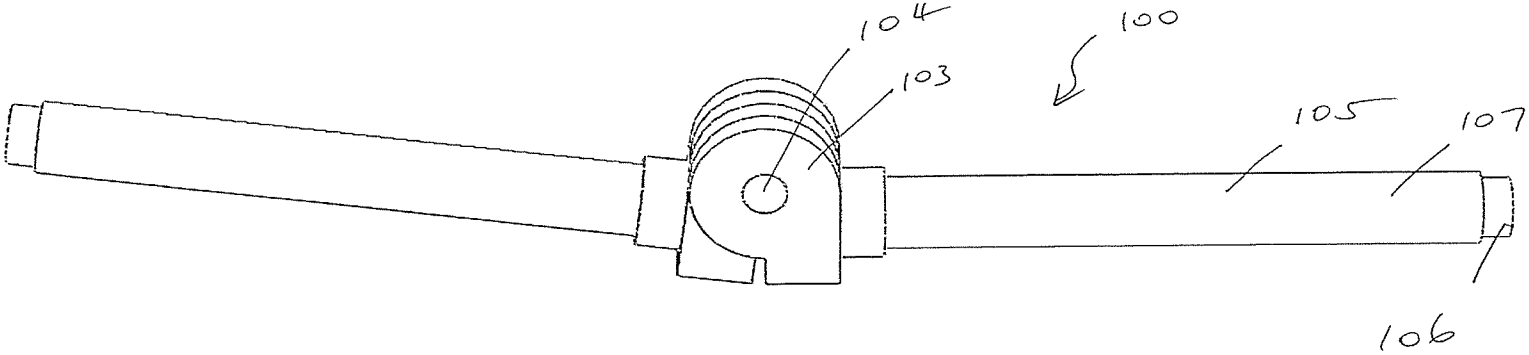
FIG. 31 is a perspective view of the hinge of FIG. 28.
Figure 32:
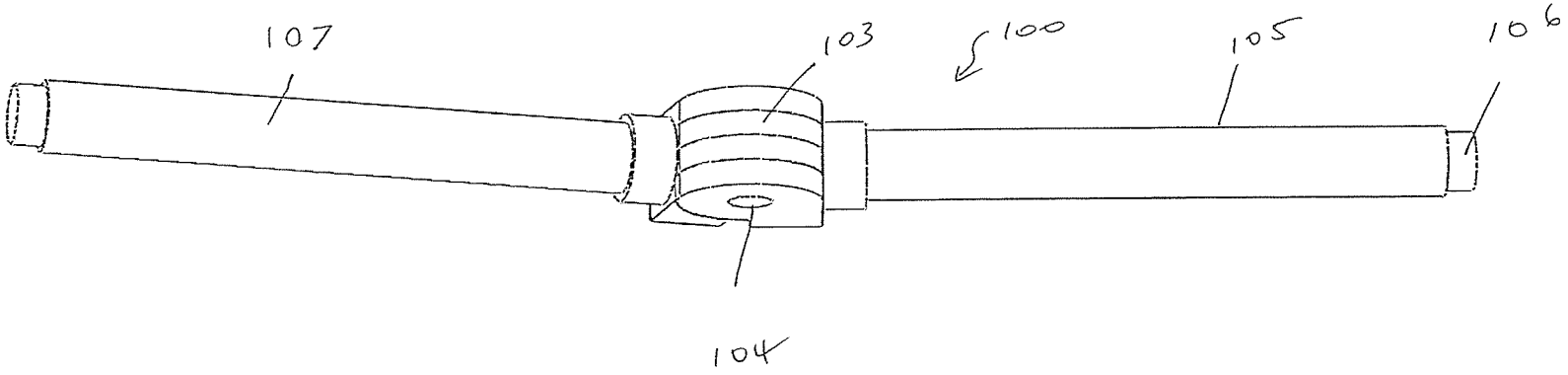
FIG. 32 is a top perspective view of the hinge of FIG. 28.
Figure 33:
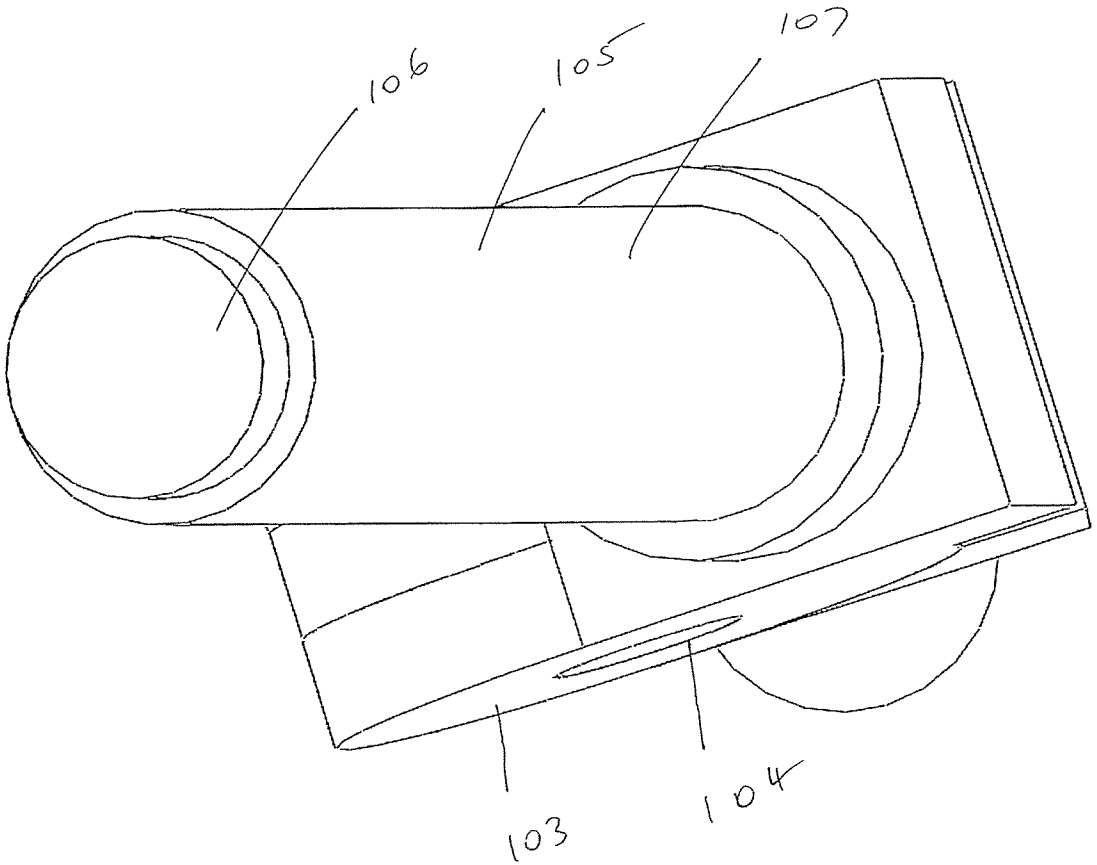
FIG. 33 is a perspective end view of the hinge of FIG. 28.

As shown in FIGS. 26 and 27, the hinge collar 11 is attached to the solid articles 30 by way of set screws or other attachment means 26 and 27. Each shaft 6 sits in a bearing tube 7 inset into each solid article 30. Shaft 6 is able to rotate in bearing tube 7. The hinge 1 and the connectors 5 are thus rotatable with respect to the solid articles 30 about the axis of the shafts 6.

The hinge 1 is rotatable such that the direction of freedom of movement of the pivoting elements 3 with respect to the solid articles 30 is changed. This change in the direction of freedom of movement of the pivoting elements 3 with respect to the solid articles 30 allows the solid articles 30 to move in varying planes with respect to one another.

In effect, the pivoting elements 3 move such that the hinge pin 4 acts as an axis of rotation. When the hinge 1 is rotated through 90 degrees, the hinge pin 4 and the pivoting elements' 3 axis of rotation is rotated through 90 degrees. As a result the freedom of movement of the hinge is shifted through 90 degrees. Depending upon the size and shape of the solid articles 30 this results in the solid articles being moveable with respect to one another in a different plane or, in certain circumstances means the hinge 1 and pivoting elements 3 are locked so that the solid articles 30 cannot move with respect to one another. That is the hinge 1 is in a locked position.

The locked and unlocked hinge positions are best shown in use in a flat solid article such as two chess board halves. This is best shown in FIGS. 22 through 25.

In the locked position shown in FIG. 25, the orientation of the hinge 1 with respect to the solid articles 30 restricts the movement of the pivoting elements 3 with respect to one another. In the locked position the axis of rotation of the pivoting elements 3 is perpendicular to the only available axis of rotation of the solid articles 30. As a result the solid articles 30 are fixed in position in relation to one another.

The collar 10 is attached to or set into the articles 30 being hinged. Each collar piece 11 is inset on one side of the hinge joint 15 extending between the articles 30. Because the collar 10 is set into the two articles 30 the hinge 1 can be flush with the articles 30.

In use, in order to unlock the hinge 1, a user rotates the hinge 1 with respect to the articles 30. This rotates the connectors 5 and connecting shafts 6 in relation to the articles 30. The collar 11, on the other hand, is fixed with respect to the articles 30. The hinge element 2 can be rotated with respect to the articles 30.

The hinge can be rotated 90 degrees. A ridge 15 associated with the connectors 5 and an inset portion 16 associated with the collar interact to stop the hinge 1 from rotating an angle greater than 90 degrees.

In other forms the hinge can be rotated through up to 360 degrees by incorporating a ridge which interacts to stop the hinge from rotating more than 180 degrees, 270 degrees or any angle. When no ridge is incorporated the hinge can be rotated 360 degrees. When the hinge can be rotated through 360 degrees the direction of freedom of movement can be rotated through 360 degrees, allowing the solid articles 30 to move in varying planes with respect to one another.

In use, the position of the hinge 1 in the hinged article and the opening movement of the hinge 1 prevents the meeting of the articles 30 joined by the hinge 1 along the hinge joint 15. There is therefore no crunching or grinding or opportunity of wear between chess board halves along the hinge joint 15.

Further, the hinge 1 allows for no hyperextension beyond the position determined as the home position. When the connectors 5 are collinear to one another the pivoting elements 3 meet to prevent hyperextension of the hinge 1.

The collar 11 and hinge element 2 allows for staged fitting, whereby the collar 11 is attached to the hinged article. Subsequently the hinge element is attached.

The hinge element 2 is composed of metal, plastic or any other rigid durable substance.

In another embodiment, the centre of gravity of the hinge element is positioned such that gravity is utilized to automate the rotation of the hinge element 2 within the collar. In another form the rotation of the hinge is actuated automatically by a motor, spring, magnet or other external means.

In the embodiment described above, the two solid articles 30 comprise chess board halves. In other embodiments the two solid articles 30 may comprise any two solid articles requiring movement in respect to one another, for example scaffolding, flooring, two panels of an articulated dividing screen, a board game board, cupboard doors, and advertising panels.

Referring to FIGS. 28-33, disclosed is a further embodiment of a hinge 100 of the present disclosure. In this illustrated form the hinge 100 comprises two pivoting elements 103. Each of the two independent pivoting elements 103 is engaged with a hinge pin 104 such that at least one of the two independent pivoting elements is rotatable about the hinge pin 104. The two independent pivoting elements 103 are therefore hingedly rotatable in respect of one another.

In the illustrated form, each of the two pivoting elements 103 further comprise a shaft 106 extending therefrom. The shaft 106 is fixed with respect to the pivoting element 103. In alternative forms the shaft may take another shape. A rotatable attachment element 105 is engaged with the shaft 106. In the illustrated form the attachment element is in the form of a cylindrical tube 107 shaped to engage the shaft by being positioned about the shaft 106.

The attachment means 105 are, in some forms, adapted to be fitted to two sections of an article such that the two sections are hinged with respect to one another. The shaft 106 adds strength and length to the hinge 100 to bear the load of the sections of the article. However, in alternative forms the shafts are shaped differently but allow for an attachment element to be rotatably or slideably attached thereto.

The pivoting elements 103 are therefore rotatable with respect to articles which are engaged with the attachment elements.

Rotation of pivoting elements 103 with respect to the articles changes the hinge moment or the direction of hinge movement with respect to the article. This change in the direction of freedom of movement of the pivoting elements 103 allows the articles to move in varying planes with respect to one another or alternatively allows for locking of the hinge when the hinge moment is aligned with an axis extending perpendicular or at an angle to the articles rather than aligning with the articles.

In effect, the pivoting elements 103 move such that the hinge pin 104 acts as an axis of rotation. When the pivoting elements 103 are rotated through 90 degrees, the hinge pin 104 and the pivoting elements' 3 axis of rotation is rotated through 90 degrees. As a result the freedom of movement of the hinge is shifted through 90 degrees. Depending upon the size and shape of the articles this results in the articles being moveable with respect to one another in a different plane or, in certain circumstances means pivoting elements 103 are locked into position with respect to one another so that the solid articles cannot move with respect to one another. That is the hinge 1 is in a locked position.

In use, in order to unlock the hinge 1, a user rotates the pivoting elements 103 and hinge pin 104 1 with respect to the articles. This rotates the shafts 106 with respect to the articles while the attachments elements 105 remain fixed with respect to the articles.

In this and other forms the pivoting elements can be rotated through up to 360 degrees When the hinge can be rotated through 360 degrees the direction of freedom of movement can be rotated through 360 degrees, allowing the solid articles 30 to move in varying planes with respect to one another.

The hinge 100 is composed of metal, plastic or any other rigid durable substance.

The hinge 100 in the illustrated form allows for the hinge to be opened automatically without direct rotational contact with the pivoting elements. Pressure by a user against the hinge allows rotation of the hinge moment with respect to the articles and the attachment elements allowing for a shift in hinge moment without a user manually contacting the pivoting elements 103. This configuration can in turn allow for automatic unlocking of the hinge in, for example, a door.

What is claimed:

1. A hinge comprising two pivoting elements hingedly connected to one another, each pivoting element having a rotatable attachment means for attaching the pivoting element to one of two articles, respectively, such that the pivoting elements are rotatable with respect to the articles, the rotatable attachment means comprising a connector which extends into the respective article, and is surrounded by the respective article, the connector being rotatably engaged with the one of two articles, respectively respective article, to allow rotation of the pivoting elements with respect to the articles to rotate the hinge, such that the hinge has a first position wherein, when the pivoting elements are attached to the articles, each article is moveable with respect to one another, and a second position wherein, when the pivoting elements are attached to the articles, each article is locked with respect to one another such that the articles cannot move relative to one another.

2. A hinge as defined in claim 1, wherein the hinge further comprises a hinge pin hingedly connecting the two pivoting elements.

3. A hinge as defined in claim 2, wherein the rotatable attachment means further comprises a hinge collar attached to the respective article and the pivoting element is rotatable with respect to the hinge collar.

4. A hinge as defined in claim 1, wherein the rotatable attachment means further comprises a hinge collar attached to the respective article and the pivoting element is rotatable with respect to the hinge collar.

5. A hinge as defined in any one of the preceding claims, wherein an axis of rotation of the pivoting elements with respect to one another and an axis of rotation of the pivoting elements with respect to the articles are perpendicular to one another.

6. A hinge as defined in claim 1 wherein the connector comprises a shaft extending from each pivoting element into the articles and rotatable within the articles.

* * * * *